United States Patent [19]

Komatsu et al.

[11] 4,163,892

[45] Aug. 7, 1979

[54] FIXING APPARATUS

[75] Inventors: Toshiyuki Komatsu, Kawasaki; Yoshio Takasu; Motoharu Fujii, both of Tokyo; Susumu Sugiura, Yamato, all of Japan

[73] Assignee: Canon Kabushiki Kaisha, Tokyo, Japan

[21] Appl. No.: 748,479

[22] Filed: Dec. 8, 1976

[30] Foreign Application Priority Data

| | | | |
|---|---|---|---|
| Dec. 15, 1975 | [JP] | Japan | 50-150023 |
| Feb. 25, 1976 | [JP] | Japan | 51-19610 |
| Jun. 3, 1976 | [JP] | Japan | 51-64916 |
| Jun. 24, 1976 | [JP] | Japan | 51-74661 |

[51] Int. Cl.[2] ..... H05B 1/00; G03G 15/20

[52] U.S. Cl. ..... 219/216; 219/388; 219/469; 432/60; 432/228

[58] Field of Search ..... 219/216, 388 W, 469-471; 432/60, 228; 355/3 FU; 250/316-318

[56] References Cited

U.S. PATENT DOCUMENTS

| | | | |
|---|---|---|---|
| 3,452,181 | 6/1969 | Stryjewski | 219/470 X |
| 3,697,726 | 10/1972 | Geronime | 219/216 |
| 3,811,821 | 5/1974 | Ariyama et al. | 219/216 X |
| 3,945,726 | 3/1976 | Ito et al. | 219/216 |
| 4,001,545 | 1/1977 | Wada et al. | 219/216 |

*Primary Examiner*—C. L. Albritton

*Attorney, Agent, or Firm*—Fitzpatrick, Cella, Harper & Scinto

[57] ABSTRACT

Apparatus for fixing a toner image on a support by pressing and heating it. To heat the toner image, the apparatus comprises first heating means for heating it with transmission or convection heat and second heating means for heating the same with radiation heat. A detecting means detects the temperature of the first heating means and in accordance with the detected information the second heating means is controlled so as to maintain the thermal condition for fixing in a constant and stable state with improved thermal efficiency.

16 Claims, 21 Drawing Figures

FIXING APPARATUS

BACKGROUND OF THE INVENTION a. Field of the Invention

The present invention relates to fixing apparatus for fixing fused toner image on a support such as a sheet of paper by heating the toner image.

b. Description of the Prior Art

Heretofore, it is well known to produce a toner image on a suitable support according to the electrophotography method, electrostatic printing method or magnetic printing method and then to fix the formed toner image if necessary.

The toner generally used for this purpose is formed of fine particles having a particle size in the range of 0.1 – 50μ and is made by mixing thermoplastic resin and coloring agent. Using such a toner, a toner image is formed on a support according to various dry- or wet developing methods. Thereafter, the formed toner image may be fused or melted and permanently fixed on the support by using heat, pressure, solvent steam or the like.

The fixing method using solvent steam is more efficient than the method using heat. But, the former has a hygienic problem caused by the scattering of stinking solvent steam.

The fixing method using pressure which is called pressure fixing method has some advantages. In the first place, it alows fixing with a small amount of energy. In the second place, an instant speed-up is possible. But, the manufacture of pressure sensitive toner is very complicated and expensive. This important drawback has prevented the method from being widely accepted and until now its use has been limited.

For the above reason, the heat fixing method has been employed most widely to fix toner image. As a heat fixing method, there are known and used two types of fixing processes. One is of the type in which the support is passed through the nip area between a pair of two heating rollers where the toner image is compressed and heated with transmission heat transmitted from the heating rollers. Another is of the type in which the support is heated with radiant heat from an infrared lamp or the like.

The former, that is, the heat fixing process using a heating roller (hereinafter called "heat roller fixing process") is acknowledged to have a better thermal efficiency, compared with the other heat fixing process using radiant heat or heat chamber.

For the heat roller fixing process, factors that will affect the fixation are temperature, pressure and contact width (nip) of the two heating rollers.

The temperature of heating rollers can not exceed a certain upper limit. The heating roller is usually composed of a heat resisting rubber. In addition, in order to prevent the toner from being offset, the surface of the heating roller is coated with liquid surface lubricant. Therefore, if the heating rollers are heated up to a too high temperature, there will arise troubles of heat deterioration of rubber and bonding agent and evaporation of the surface lubricant. As usual, the upper limit for the heating roller's surface temperature is about 200° C. The heating rollers can not be heated to a temperature over this upper limit for the reason mentioned above.

The heating value or calorific value transmitted from the heating roller to the toner and support is represented by the following equation:

$$\partial Q/\partial t = A \cdot K \cdot (\partial T/\partial X)$$

wherein Q is heating value (cal) transmitted from the heating roller to the toner and support, t is the time (sec), A is the area of surface contact ($cm^2$), K is the heat transfer coefficient (cal/°K.$cm^2$sec), T is temperature difference between two heat transmissive bodies and X is the distance from the heating roller surface (cm).

So, ($\partial Q/\partial t$) represents the transmitted heating value (cal/sec) per unit time and ($\partial T/\partial X$) represents the temperature gradient (°K./cm). The equation means that when the difference in temperature between the heating roller surface and support including toner is large, the velocity of heat transmisson becomes high. In other words, the velocity of heat transmission or convection is high at the beginning of contact and thereafter it gradually drops. Therefore, at the beginning of a fixing step, heat is rapidly transmitted from the heating rollers to support owing to the existing large temperature difference. However, with the rise of temperature of the toner, the heat transmission rate becomes remarkedly smaller. Due to this fact, the fixing speed attainable by the heat roller fixing process is relatively low, which is an important drawback of this fixing process.

In order to attain a high speed fixation by heating rollers, it is necessary to keep a steep temperature gradient by raising the heating surface temperature up to a point far higher than the fusing point of the toner or to extend the contact time by bringing the two rollers into contact with the highest possible pressure so as to widen the nip width accordingly.

However, as mentioned above, heating the rollers to high temperature may cause a problem. In practice, it is not allowed to raise the roller surface temperature up to a point far higher than the fusing point of the toner which is generally in the range of from 100° C. to 150° C. On the other hand, the high pressure contact of a pair of heating rollers may cause the deformation and deterioration of the rubber material at the surface portion of the heating rollers. Since the heat deprived of by the support becomes large, the thermal efficiency may be reduced accordingly. Also there may occur some other troubles such as formation of creases on the support, vagueness of produced image and mechanical instability of the apparatus.

In the case of a radiant heat fixing process, the heating value given to the toner by radiant rays is represented by the following equation:

$$QR = A \cdot \alpha \cdot ER \cdot t$$

wherein QR is the heating value given to the toner (including the support) by radiant rays, $\alpha$ is the absorption heat conversion efficiency, A is the area of irradiation ($cm^2$), ER is the radiant value (cal/$cm^2$ sec) and t is the irradiation time. As will be understood from the above equation, the heating value given to toner by radiant rays is proportional to the radiant ray value and irradiation time. The temperature rising speed hardly depends upon toner temperature, which is different from the case of the heat roller fixing process. Therefore, the advantage of a rapid conversion of absorbed radiant rays to heat can be obtained. In view of these facts, it may be considered that the radiant heat fixing process is preferable for a rapid fixation. But, in practice, its thermal efficiency is very low and it is said that the portion of radiant rays practically used for fixing is only 20% at the most. This is because the heat transmission efficiency of the toner layer is extremely poor. As known to those skilled in the art, fixing is completed by the fusion of toner particles and their adhesion to each other as well as to the support. It is necessary for fixing to have heat transferred from the raised temperature portion of the toner surface layer to the support surface and to keep a sufficient temperature on the intersurface between the toner and support. An unfixed toner layer (voids: about 50%) in the conventional radiant heat fixing process contains a large amount of air and, therefore, its heat transfer rate is only about ½-⅔ of the rate of a compressed toner layer (voids: 10-20%). In addition, the thickness of the unfixed toner layer is larger than that of the compressed toner layer. For these reasons, the heat transmission efficiency of the toner layer is very poor. As other reasons for the low heat transmission efficiency,, the following facts may be pointed out.

Absorption of radiant thermal rays occurs only at a limited area near the surface of the toner layer, which causes the temperature to rise only at the surface portion of the toner layer. Since the radiant ray irradiated to the toner layer hardly reaches the inside of the layer, a long time is required to completely heat and melt the whole toner layer.

Although toner has a relatively high absorption factor of radiant thermal rays, the support which is the background portion of image shows a low absorption rate. Due to it, the heat absorbed by the toner portions is dispersed out in the support and the rise of temperature at the toner portion is delayed.

In summary, the low thermal efficiency in the radiant heat fixing process is due to the fact that the area of radiant ray absorption of the toner image portion is too small and that the radiant rays which the toner image portion has absorbed does not adequately contribute to fixation.

SUMMARY OF THE INVENTION

Accordingly an object of the invention is to provide an improved fixing apparatus which eliminates the above described drawbacks involved in the prior art.

Another object of the invention is to provide an improved fixing apparatus which allows the carrying out of fixing with an increased thermal efficiency and with a smaller consumption of electric power.

A further object of the invention is to provide an improved fixing apparatus which allows the carrying out of fixing at a high rate of speed but with a smaller consumption of electric power.

Other and further objects, features and advantages of the invention will appear more fully from the following detailed description.

DESCRIPTION OF THE PREFERRED EMBODIMENT

Figure 1:
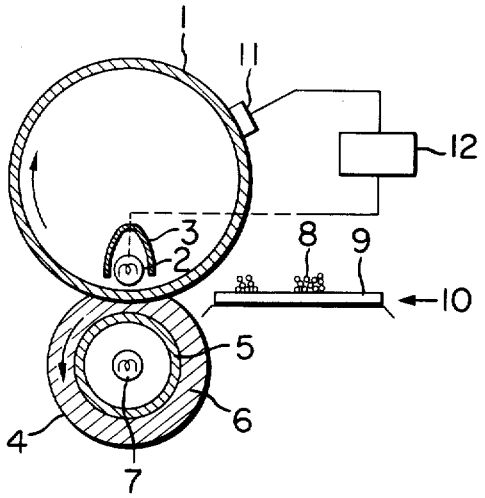
FIG. 1 is a cross-sectional view of an essential part of a fixing apparatus showing a first embodiment of the invention.

Referring to FIG. 1, there is shown a fixing apparatus embodying the invention. Reference numeral 1 designates a heat resisting and thermal ray transmissive cylinder that is composed of a thermal ray transmissive roller of glass such as pyrex or quartz. 2 designates a heat source which may be, for example, an infrared lamp, a halogen lamp or a flash lamp and 3 designates a reflecting mirror. The heat source 2 and the reflecting mirror 3 are arranged in the cyliner 3 as illustrated in FIG. 1. At the under side of the cylinder and pressed against its circumferential surface, there is provided a heating roller 4 comprising a metallic pipe 5 and a rubber layer 6 applied on the circumference of the pipe. The layer 6 is composed of heat resisting rubber such as silicone rubber. Within the heating roller 4, there is provided also a heat source 7 such as an infrared lamp. The cylinder 1 or the heating roller 4 is operationally connected with a driving source (not shown) so that this cylinder 1 and the heating roller 4 elastically engaged with it may be rotated in the direction indicated by the arrow, respectively. The thermal rays emitted from the heat source 2 are directed to the contacting area between the cylinder 1 and the heating roller 4.

The cylinder 1 is heated by both the heating roller 4 and the heat source 2.

According to the conventional electrophotography process, a toner image 8 is formed and transferred to a sheet of paper 9. Thereafter, the sheet with the transferred image is advanced in the direction of arrow 10 to the nip area between the cylinder 1 and the heating roller 4.

While passing through the nip area, the sheet 9 is pressed against the cylinder with its surface having the toner image being closely contacted with the surface of the cylinder. During this contacting time, the thermal rays radiated from the heat source 2 and the heat transmitted through the cylinder 1 make the toner image 8 fused and fixed on the surface of the sheet 9.

A temperature detector 11 such as a thermistor detects the circumferential surface temperature of the cylinder 1. The amount of radiant heat from the heat source 2 is controlled through a control circuit 12 by changing the electric power supplied to the heat source in accordance with the detected temperature on the circumference surface of the cylinder 1.

Figure 2:
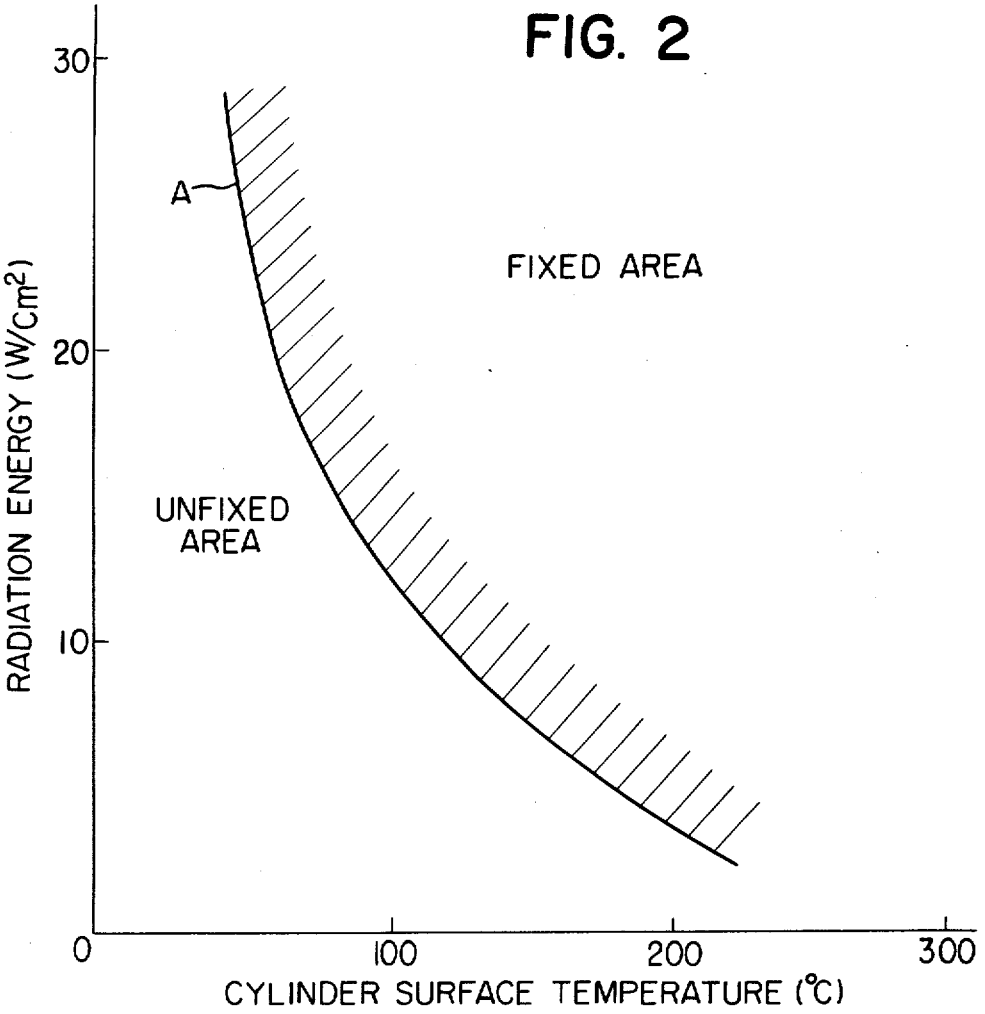
FIG. 2 shows a correlation curve between cylinder surface temperature and radiation energy.

FIG. 2 shows a test result obtained from experiments in which fixing are effected by variously changing the thermal value of radiation from the heat source 2 and the surface temperature of the cylinder 1.

The cylinder surface temperature is given on the abscissa and the radiation energy of the heat source is on the ordinate. The curve A indicates the boundary line for fixing at a sheet transporting speed of 80 cm/sec. The hatched area on the right side of the curve A (fixed area) is the area where fixation is passible at the given speed whereas the area on the left side (unfixed area) is area where fixation is impossible.

In the apparatus described above, the heat source 2 is controlled through the control circuit 12 for controlling the supply of power to it so that the heat source may generate a sufficient amount of radiant heat to fix the image on the sheet in accordance with the cylinder surface temperature.

Figure 3:
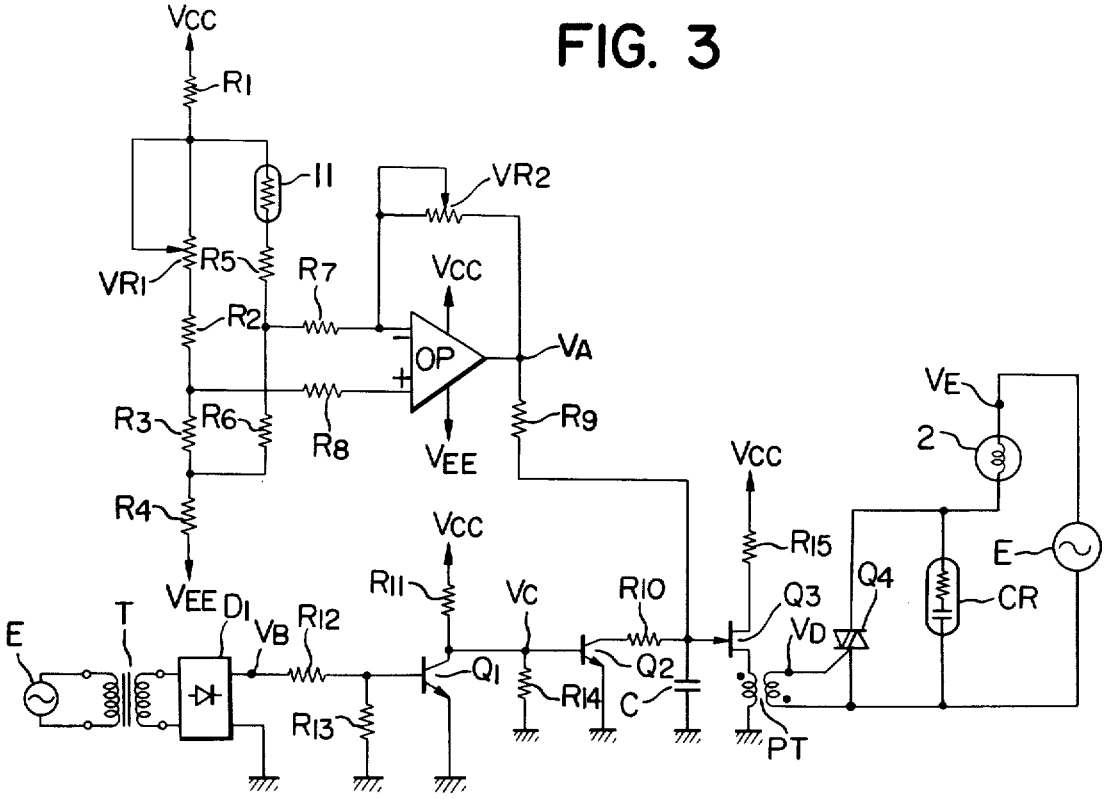
FIG. 3 is a control circuit adopted for the apparatus shown in FIG. 1.

One concrete example of the control circuit 12 is shown in FIG. 3.

In the drawing, reference character E designates a AC source, Vcc and $V_{EE}$ and DC sources, $R_1$ through $R_{15}$ are fixed resistors, $VR_1$ and $VR_2$ are variable resistors, OP is an operational amplifier and $Q_1$ -$Q_3$ designate switching elements, of which, for example, $Q_1$ and $Q_2$ may be transistors and $Q_3$ may be a unijunction transistor. $Q_4$ designates an AC switching element such as a two-way thyristor, T is a transformer, Pt is a pulse transformer, C is a charging condenser, CR is a spark quencher for the thyristor and $D_1$ designates a full-wave rectifier. In this example, use is made of a thermistor as detector 11 and an infrared lamp as heat source 2.

The arrangement described above is so designed that when the temperature at the detecting point, namely the cylinder surface temperature is $T_1$, the infrared lamp 2 is supplied with sufficient power to effect fixing at the temperature $T_1$ and the power supplied to the lamp 2 is continuously changed in accordance with the detected cylinder surface temperature until the temperature $T_1$ has reached a predetermined temperature $T_2$ ($T_1 < T_2$). In this manner, the fixing apparatus is controlled according to a control method of proportional position action and maintained in fixing possible condition.

Now referring to FIG. 4 showing wave forms at VA, VB, VC, VD and VE of the control circuit, the operational action of the appratus is explained.

By cutting the power source on, the current is introduced into the whole circuit so that the heat sources 2 and 7 become conductive. When the cylinder surface temperature is lower than the predetermined temperature, the internal resistance of the thermistor 11 becomes high and respective point voltage formed by the resistors' bridging is high on the negative (−) side of the operational amplifier OP and low on its positive (+) side. Therefore, as the output voltage V (see FIG. 4(A)), there is produced a high positive voltage and the condenser C is charged at a rate of $V \cdot e(t/CR_3$. But, once the time when the potential of the condenser C has reached switching voltage of the unijunction transistor $Q_3$, the condenser C is discharged so that at the pulse transformer PT, there is produced an output pulse (see FIG. 4(D)) which turns the two-way thyristor $Q_4$ on.

Figure 4A:
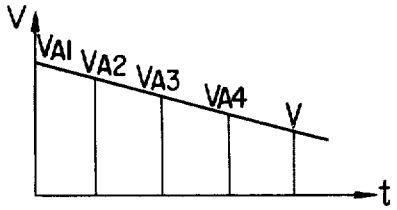
FIGS. 4(A) to 4(E) show wave forms at several portions of the control circuit.
Figure 4D:
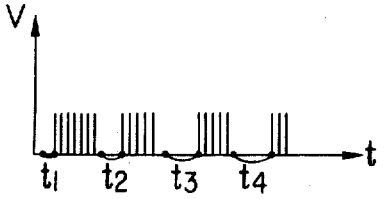
Figure 4B:
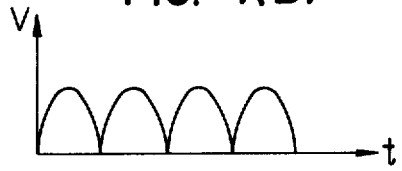
Figure 4E:
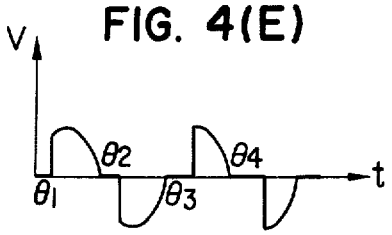
Figure 4C:
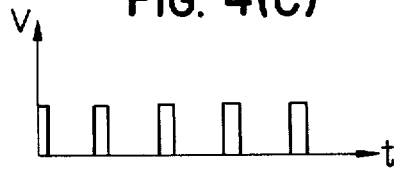

If this occurs at a time point after the interval time $T_1$ has elapsed starting the point OV of the power source E, a wave form as illustrated by the first one in FIG. 4(E) will be given for the infrared lamp 2. Accordingly, the cylinder surface temperature rises owing to the heat from the infrared lamp 2 as well as the heating roller 4. As a result, in the following half cycle, the internal resistance of the thermistor 11 drops down so as to lower the output voltage V of the operational amplifier OP to $V_{42}$. Thereby,, the charging time required for attaining the switching voltage through the resistor 3 and the condenser C will be lengthened compared with the time for the previous half cycle. Therefore, for the lamp 2, there is now given a wave form of voltage with its interrupting angle being increased from $\theta_1$ to $\theta_2$ as illustrated in FIG. 4(E). As a result, the voltage supplied to the infrared lamp 2 is decreased this time compared with that at the previous cycle time. The variable resistors $V_{R1}$ and $V_{R2}$ are used to adjust the predetermined temperature that is variable as desired and to determine the range of proportional position action.

According to the operational mode described above, when the cylinder surface temperature is low, a larger amount of power is supplied to the infrared lamp 2 whereas when the temperature is high, a smaller amount of power is supplied to it. In either case, therefore, the infrared lamp 2 serving as a heat source can generate a sufficient amount of radiant heat enough to fuse and fix the toner image, in accordance with the detected cylinder surface temperature.

Figure 5:
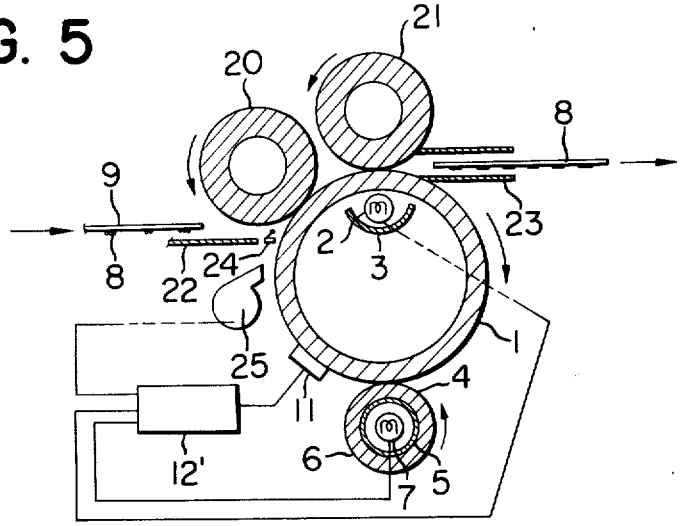
FIG. 5 shows a second embodiment of the invention.

FIG. 5 illustrates another embodiment of the invention. In the drawing, like reference numerals designate like or corresponding parts or elements having the same function as that in FIG. 1.

Reference numerals 20 and 21 designate guide rollers contacting with the circumferential surface of the cylinder 1 under a suitable pressure, which guide rollers are covered with heat resisting rubber.

22 designates a guide plate for inserting the sheet and 23 is a guide plate for discharging the sheet. The cylinder 1, the rollers 20 and 21 and the heating roller 6 are rotated in the direction indicated by arrow respectively. The sheet 9 on which a toner image 8 is formed is fed into the nip area between the cylinder 1 and the roller 20 along the guide plate 22 with its toner image side down. A microswitch 24 detects the transportation of the sheet 9 into the fixing apparatus. To cool the cylinder surface, there is provided a blower 25 which can blow cooling air against the circumference of the cylinder if necessary.

When the sheet 9 passes through the nip area between the cylinder 1 and the roller 20, it is preheated with the heat transmitted through the cylinder 1 to compress the toner image and, thereafter, when it passes through the next nip area between the cylinder 1 and the roller 21, the sheet is heated to fix the toner image with the transmitted heat as well as the thermal ray radiated from the infrared lamp 2.

Figure 6:
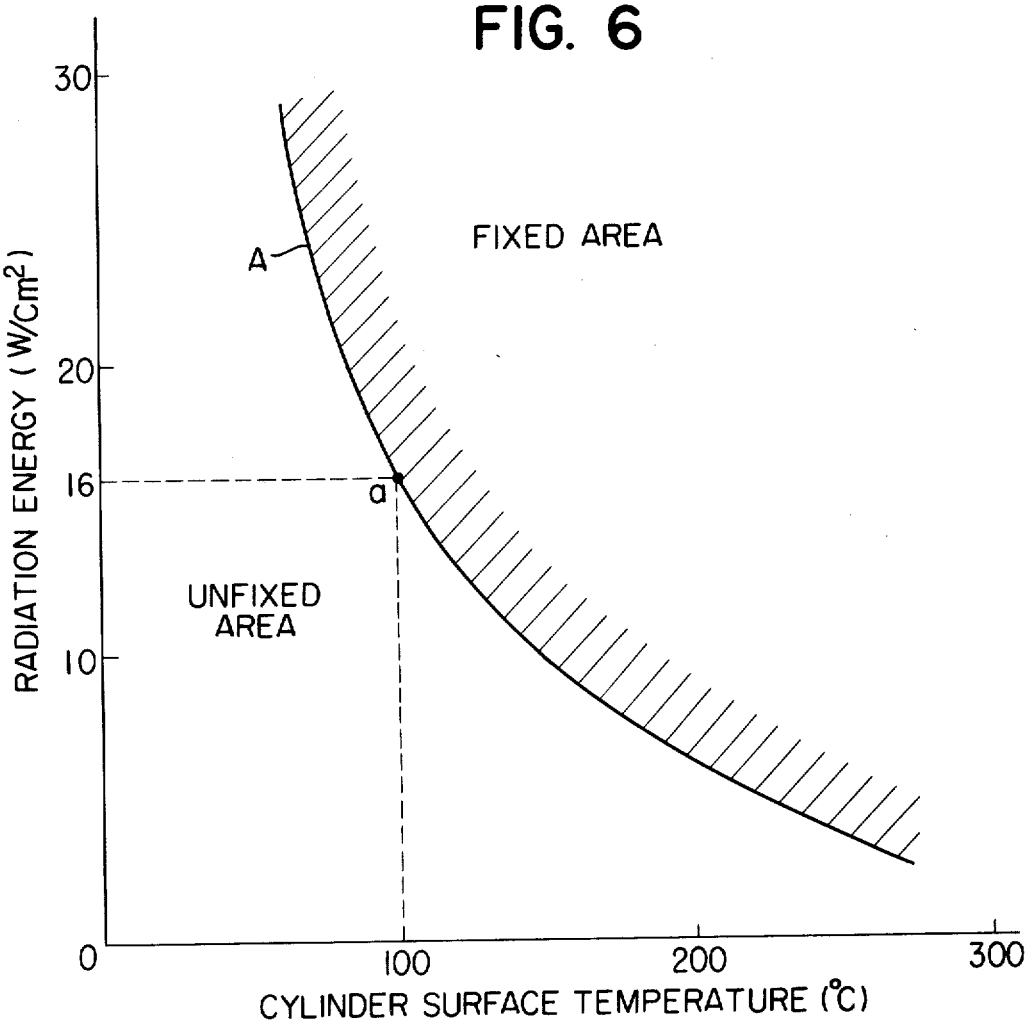
FIG. 6 shows another correlation curve between cylinder surface temperature and radiation energy.

FIG. 6 shows the result of experiments of fixation performed with the above described fixing appararus, where the thermal value of the radiation from the infrared lamp 2 and the cylinder surface temperature were variously changed. In FIG. 6 like as FIG. 2, the abscissa represents the cylinder surface temperature and the ordinate represents the radiation energy of the infrared lamp 2. Again the curve A indicates the boundary line for the thermal condition in which fixing is feasible when the sheet 9 is conveyed at a rate of 100cm/sec. The hatched area on the right side of the curve (fixed area) is the area where fixing is possible at the given high speed. For example, the point a on the curve A indicates that when the cylinder surface temperature is set at 100° C. and the radiation energy is adjusted to 16W/cm$^2$, a fixation of toner image at a high speed of 100cm/sec can be performed.

In the embodiment shown in FIG. 5, the width of contact (nip width) between the sheet 9 and the cylinder 1 is the same as the nip width between the cylinder 1 and each of the rollers 20 and 21, which was 5mm. The width of irradiation of the radiant ray in the direction of sheet transportation was 15mm in this case.

In FIG. 6, intersection of the extension of the curve A and the abscissa axis will give the thermal condition required for fixing according to a conventional heat fixing method using transmitted heat only. On the other hand, intersection of the extension of the curve A and the ordinate axis will indicate the thermal condition required for fixing according to another conventional heat fixing method using radiant heat only. In the former case, it will be understood that an extremely high cylinder surface temperature over 300° C. is required for effecting a fixation at a high speed of 100 cm/sec. Also, in the latter, it will be understood that a very large amount of radiation energy over 50W/cm$^2$ is required for effecting the fixation.

This means that in either case a very large amount of electric power is required to perform the desired fixation of toner image. In addition, there will arise another problem that it becomes very difficult to maintain the apparatus in stable operational state against such a high temperature.

Figure 9A:
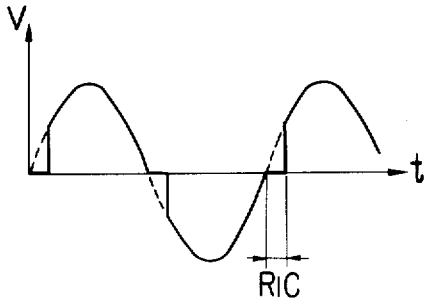
FIGS. 9(A) and 9(B) show voltage wave forms of the heat source 7 used in this embodiment.
Figure 9B:
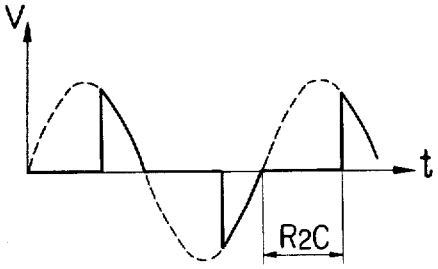

In contrast with these conventional fixing systems, the present invention allows a high speed fixation with a smaller amount of electric power, as will be seen from the curves in FIG. 9.

Figure 7:
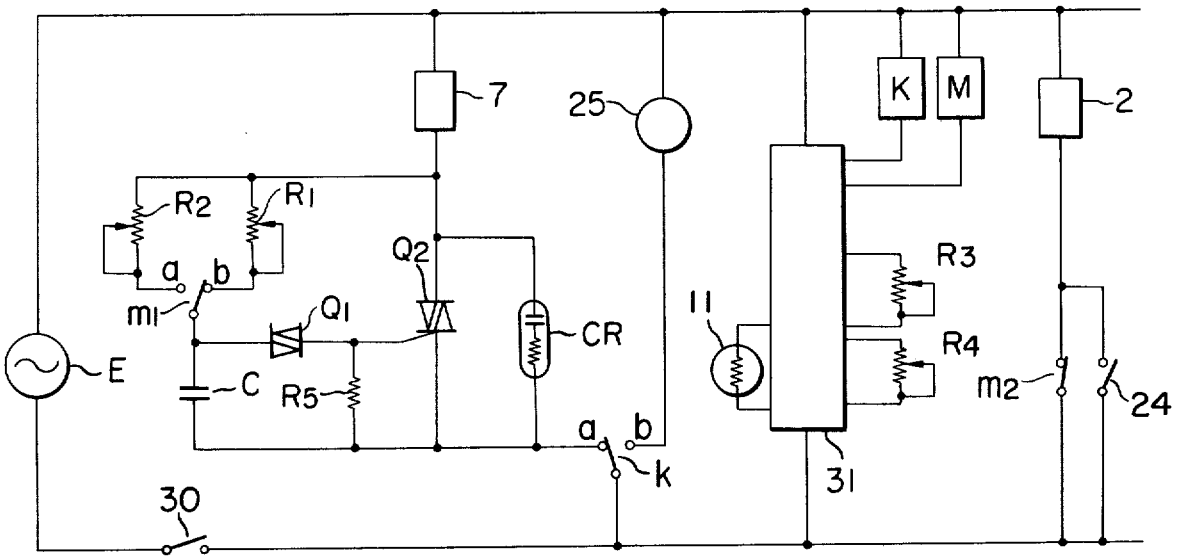
FIG. 7 shows a control circuit adopted for the apparatus shown in FIG. 5.

FIG. 7 shows a detailed arrangement of the control circuit 12' used in the apparatus shown in FIG. 5.

Figure 8:
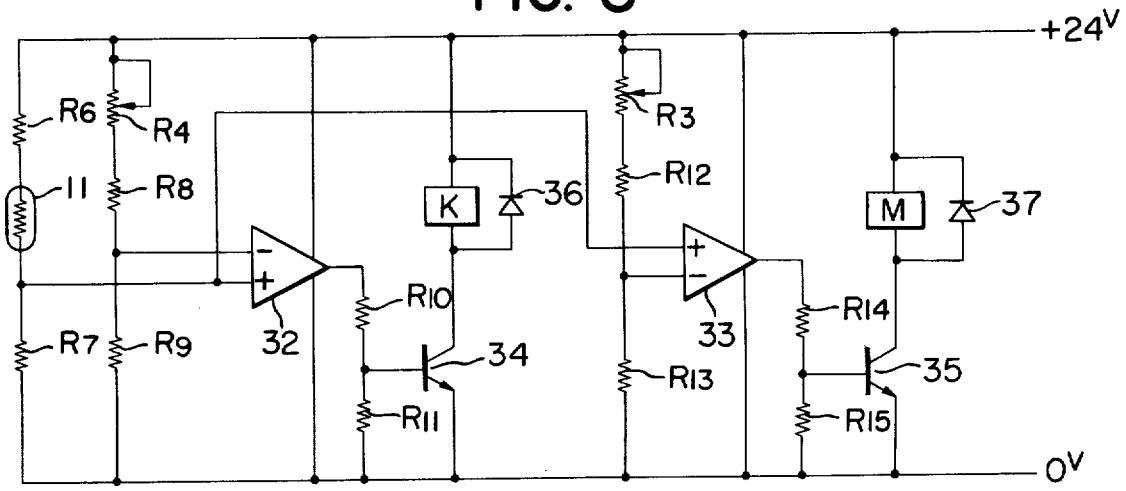
FIG. 8 is a wiring diagram of a temperature control circuit.

In the drawing of FIG. 7, reference numerals and characters designate the following members and elements:

K and M are relays, $R_1$ through $R_4$ are variable resistors, C is a condenser, $Q_1$ is a switching element such as a trigger diode, $Q_2$ is a two-way switching element such as a thyristor, CR is a spark quencher, $m_1$, $m_2$ and k are switches for relays M and K, E is an AC source, 30 is a source switch and 31 designates a temperature control circuit. The temperature control circuit is shown in detail in FIG. 8. In FIG. 8, $R_6$ through $R_{15}$ are fixed resistors, 32 and 33 are operational amplifiers, 34 and 35 are transistors and 36 and 37 designate diodes.

11 is the thermistor shown in FIG. 7 and also K and M are relays shown in FIG. 7.

Now, operational action of the above described apparatus will be explained.

When the power source is off, each of the switches is in its starting position shown in the drawing. Further, prior to starting the operation of the apparatus, the infrared lamp 2 has been adjusted to generate a predetermined amount of radiant heat. For example, if one wishes to perform fixing at a high speed of 100 cm/sec as shown in FIG. 6, he adjusts the lamp 2 so that it may give an amount of 16W/cm$^2$ of radiation energy. Also, the heat source 7 has to be adjusted through the resistor $R_3$ so that for a given radiation energy, a fixing possible cylinder surface temperature $T_1$ may be obtained. In the particular case mentioned above, the temperature $T_1$ must be at least 100° C. as seen from the curve A in FIG. 6.

Now, when the power source switch 30 is turned on, the heat source 2 and 7 become conductive and, thereby, the circumferential surface of the cylinder 1 is heated by the infrared lamp 2 and the heating roller 4. During some warming-up time period required to attain the predetermined cyclinder surface temperature $T_1$, the heat source 7 is supplied with a certain voltage V that is determined by the charging rate which is, in turn, determined by a given time constant $R_1C$., as indicated by the wave form of FIG. 9(A).

Figure 10:
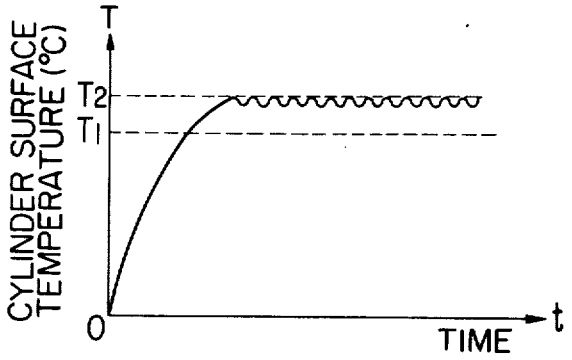
FIG. 10 is a curve showing the change of cylinder surface temperature with time.

FIG. 10 is a correlation curve between cylinder surface temperature and time. The curve indicates that when the source switch is turned on, the cylinder surface temperature will rise rapidly up to the predetermined fixing possible temperature $T_1$ set by the variable resistor $R_3$.

When the cylinder surface temperature has reached the predetermined temperature $T_1$, the temperature control circuit 3 which responds to the output signal from the thermistor 11, causes the relay to actuate so that the switch $m_2$ is opened and the infrared lamp 2 is cut off. At the same time, the contact of the switch $m_1$ is brought into contact with the contact point a. As a result, as indicated by the wave form of FIG. 9(B), the heat source 7 is supplied with a certain voltage V determined by the charging rate that is determined by a given time constant $R_2C$.

In this manner, after the cylinder surface temperature has once reached the fixing possible temperature $T_1$, the heat source 7 can be supplied with a smaller amount of electric power compared with the supplied power during the warming-up period.

The electric power supplied to the heat source 7 after the predetermined temperature $T_1$ has been attained is adjusted in the manner that the heat which is derived of from the cylinder surface by the sheet 9 contacting with it during fixing may be filled up in the almost same level of thermal value.

Since the infrared lamp 2 is cut off when the predetermined cylinder surface temperature $T_1$ has been attained, the end of the warming-up period can be visually noticed by making the radiant ray from the infrared lamp 2 externally visible. At the end of the warming-up period, the sheet 9 can be fed to the fixing apparatus. The transportation of sheet into the apparatus turns the microswitch 24 on so that the infrared lamp 2 is put on. Now, the sheet 9 receives a given amount of transmitted heat from the cylinder 1 heated up to the predetermined temperature as well as a given amount of radiant heat from the infrared lamp 2 so that toner image may be fused and fixed on the sheet.

When the sheet 9 is discharged from the fixing apparatus, the infrared lamp 2 is again cut off.

In case that a number of sheets are continously fed into the apparatus, there arises a problem of overheating the cylinder 1 due to keeping the lamp 2 on for a long time. This will cause damage to the sheets 2 by overheating or impair the stability of the apparatus.

To obviate the problem, the control circuit contains the variable resistor $R_4$. The resistor is so adjusted that when the cylinder surface temperature exceeds a predetermined maximum temperature $T_2$ ($T_1 \leqq T_2$), the relay K may be actuated by an output signal from the temperature control circuit 31.

With the actuation of the relay K, the contact of the switch k is brought in contact with the contact point b so that the blower 25 starts operating whereas the heat source is turned off. The blower 25 directs cooling air to the cylinder surface and continues blowing until the cylinder surface temperature has decreased to the predetermined point. In this manner, the fixing condition is maintained constant and the toner image can be heated under an optimum condition. This stable thermal condition may be seen from FIG. 10 where after the warming-up period, the cylinder surface temperature is maintained at the predetermined temperature $T_2$ in spite of the continuous transportation of sheets.

Although the heating roller 4 has been particularly shown to heat the cylinder surface, it is obvious that infrared lamp, oil bath or sand bath also may be used for this purpose. Furthermore, to notice the end of the warming-up period, the closing and opening action of the switch $m_2$ may be used instead of detecting on-off of the infrared lamp 2.

When the fixing speed has to be changed, the variable resistor $R_3$ is to be readjusted so that the cylinder surface may be heated to a given cylinder surface temperature in accordance with the predetermined amount of radiant heat.

Figure 11:
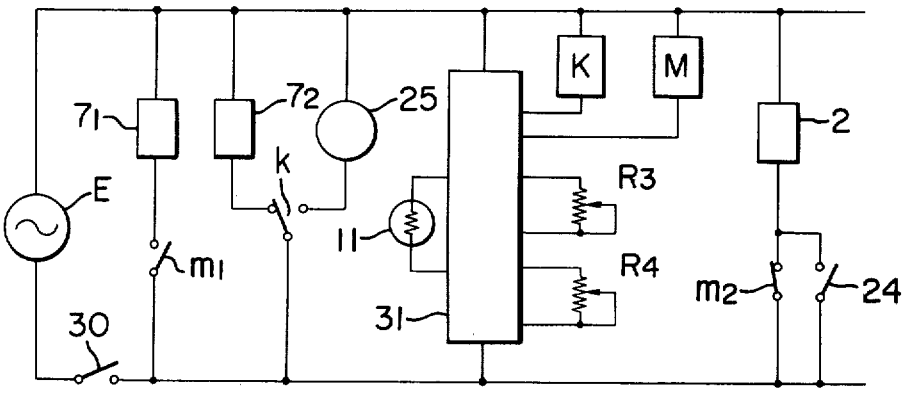
FIG. 11 shows another embodiment of a control circuit.

FIG. 11 shows a further embodiment of the invention. In the drawing, like reference numerals and characters designate like or corresponding members or elements shown in above described embodiments.

In this embodiment, the heating roller 4 contains therein two heaters $7_1$ and $7_2$. During the warming-up period, the infrared lamp 2 and the heater $7_1$ are cut off and only the heater $7_2$ remains conductive.

The number of heating rollers is never limited to only one. A plurality of heating rollers may be provided to selectively actuate them in accordance with the detected cylinder surface temperature.

As seen from the foregoing, the apparatus according to the present invention has many remarkable advantages.

Since the apparatus is designed to detect the cylinder surface temperature and heat it up to a predetermined fixing possible temperature in accordance with the detected information, it is allowed to carry out fixing at a high speed under a stable condition.

Further, the combined use of radiant heat from the radiation source and transmissive or convective heat from the cylinder surface brings forth a substantial improvment in thermal efficiency compared with the conventional fixing system using either radiant heat or transmissive heat of a heating roller. Therefore, a high speed fixing can be performed with a smaller amount of electric power.

A further advantage of the invention is found in the fact that attaining time to the fixing possible temperature is shortened by the above described combined heating of the cylinder surface and that the waiting time is also made shorter accordingly. Furthermore, the apparatus according to the invention allows the continuous carrying of high speed fixation without interposing any waiting time and only with the operation of radiant heat source. This is because after the cylinder surface temperature has once reached the predetermined fixing possible temperature, the cylinder surface is always maintained at the given temperature by the heating roller even when the radiant heat source is cut off.

Figure 12:
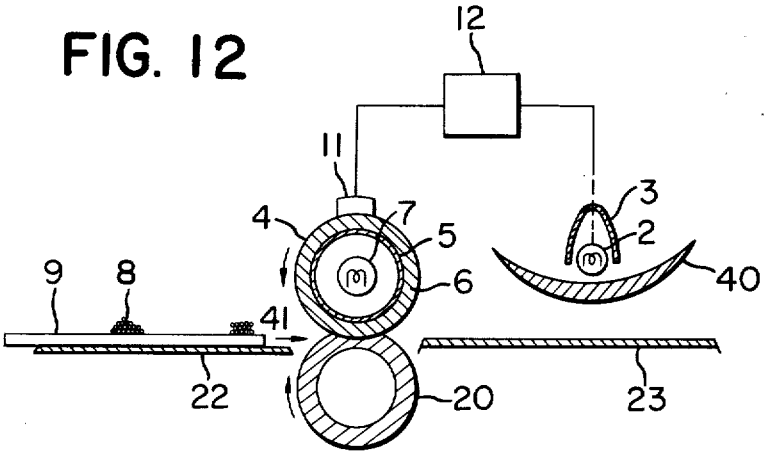
FIGS. 12 through 16 show further embodiments of the invention, respectively.

FIG. 12 shows the third embodiment of the invention.

In this embodiment, a heating roller 4 is contacting with a guide roller 20 under a suitable pressure. On the discharging side of the guide roller 20, there are arranged an infrared lamp 2 and a condenser lens 40.

The sheet 9 with a toner image 8 formed thereon is conveyed in the direction of arrow 41 to the nip area of the guide roller 20 where the toner image is compressed and heated with transmissive heat of the heating roller 4, and thereafter it is again heated with radiant thermal ray from the infrared lamp 2.

FIGS. 13 through 16 show further embodiments of the invention.

Figure 13:
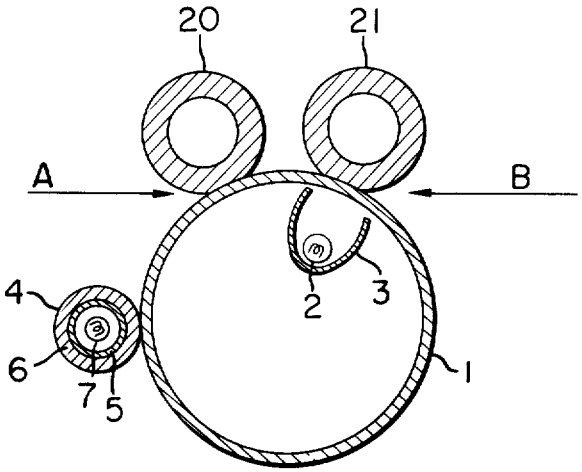

In the embodiment of FIG. 13, a heat resisting pyrex glass cylinder 1 having an external diameter of 120 mm is contacted with two guide rollers 20 and 21 under the pressure of 16 Kg of total load, each of the guide rollers being composed of a cylindrical tube of aluminum covered with a layer of silicone rubber 11 mm thick and having an external diameter of 50 mm. The nip width of each contacting area is 10 mm. The center distance between the rollers 20 and 21 is 65 mm. Within the cylinder 1, there are provided a halogen lamp 2 of 1.5 KW power and a reflecting mirror 3 behind it. The radiated ray from the halogen lamp 21 is directed only to the contacting area of the roller 21.

When a paper sheet 8 or 64.5 g/m$^2$ carrying toner of NP 5,000 made by Canon Kabushiki Kaisha was introduced into the apparatus in the direction of arrow A and fixing was performed passing the sheet 9 through each contacting area, the maximum fixing speed was 50 cm/sec. Then, the same kind of sheet 9 was introduced into the apparatus in the direction of arrow B. This time, the maximum fixing speed was 40 cm/sec. In either experiment, the cylinder surface temperature was maintained at 100° C. When fixing was carried out passing the sheet 9 through only one contacting area between the roller 21 and the cylinder 1 without passing it through another contacting area between the roller 20 and cylinder 1, the maximum fixing speed was 30 cm/sec.

Figure 14:
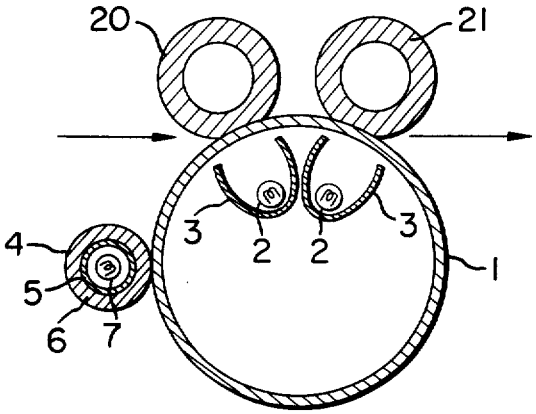

In the embodiment of FIG. 14, two sets of a halogen lamp 2 and a reflecting mirror 3 are arranged opposed to each contacting area of two rollers 20, 21 and the cylinder 1 respectively. With this apparatus, a maximum fixing speed of 75 cm/sec was attained. When the capacity of two halogen lamps was changed to 750 W, the maximum fixing speed was 45 cm/sec.

Figure 15:
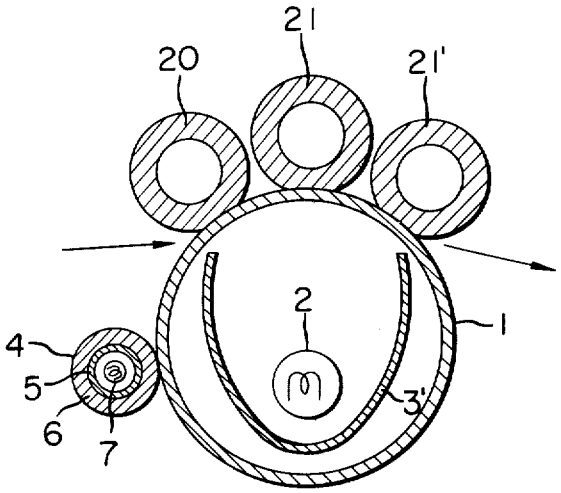

In the embodiment of FIG. 15, one more guide roller 21' similar to the other two guide rollers 20 and 21 is provided. All three guide rollers are contacted with the cylinder 1 under the same condition. Within the cylinder 1, there are arranged a halogen lamp 2 and reflecting mirror 3'. The reflecting mirror 3' is large enough to direct the radiated ray from the halogen lamp 2 to all of the three contacting areas. The center distance between two each neighboring rollers is 55 mm. With the apparatus of this embodiment, 55 cm/sec of maximum fixing speed was attained.

Figure 16:
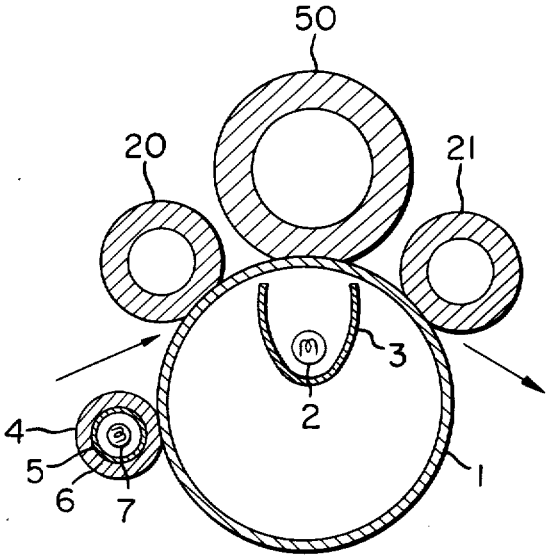

In the embodiment of FIG. 16, between two guide rollers 20 and 21, there is provided a third guide roller 50 having an external diameter of 70 mm. It is contacted with the cylinder 1 under the pressure of 25 Kg of total load. It is composed of a cylindrical tube of aluminum covered with a layer of silicone rubber 16 mm thick. The nip width of contacting area of the guide roller 50 is 15 mm. The radiated ray from the halogen lamp 2 is directed only to the contacting area of the guide roller 50. The center distance between two neighboring guide rollers is 65 mm. The maximum fixing speed attained with the apparatus of this embodiment was 65 cm/sec. When fixing was carried out passing the sheet through only the two contacting areas between guide rollers 50 and the cylinder 1 and between the guide roller 21 and the cylinder 1, the maximum fixing speed was 55 cm/sec. Further, when passing the sheet through only one contact area between the guide roller 50 and the cylinder 1, the maximum fixing speed was 40 cm/sec.

While the invention has been particularly shown and described with reference to preferred embodiments thereof, it will be understood by those skilled in the art that the foregoing and other changes in form and details can be made therein without departing from the spirit and scope of the invention.

What we claim is:

1. A fixing apparatus comprising:

first heating means, having a heatable surface which is contactable with a toner image bearing member, for heating a toner image on said toner image bearing member;

urging means for press-contacting the toner image bearing member to said surface;

second heating means for applying radiant heat to the toner image on the toner image bearing member at least at an area where it is press contacted with said first heating means;

detecting means for detecting the temperature of said surface; and control means, associated with said detecting means, for controlling said second heating means in response to the temperature of said surface;

wherein said surface of said first heating means is a surface of a rotatable cylinder formed of a material capable of passing said radiation heat therethrough, and said second heating means is disposed within said cylinder.

2. An apparatus according to claim 1, wherein said second heating means comprises a heat radiation source for supplying radiant heat at least to the area where said surface and the toner bearing member are contacted, and wherein said control means includes means, connected to said heat radiation source, for changing the electric power supplied to said heat radiation source.

3. An apparatus according to claim 2, wherein said power changing means includes a comparison circuit for comparing the surface temperature of said first heating means and a preset temperature, and power supply means for supplying power to said heat radiation source in accordance with the difference between said temperatures.

4. An apparatus according to claim 1, further comprising second control means for controlling said first heating means, said second control means being associated with said detecting means and responsive to the surface temperature of said first heating means.

5. An apparatus according to claim 4, wherein said first heating means includes a heat source for heating said surface, and said second control means includes means, connected to said heat source, for changing the electric power supplied to said heat source.

6. An apparatus according to claim 5, wherein said changing means includes a comparison circuit for comparing the temperature of said surface with a predetermined temperature, and means for supplying power to said heat source in correspondence with the difference between the temperatures.

7. A fixing apparatus comprising:

first heating means, having a heatable surface which is contactable with a toner image bearing member, for heating a toner image on said toner image bearing member;

urging means for press-contacting the toner image bearing member to said surface;

second heating means for applying radiant heat to the toner image on the toner image bearing member at least at an area where it is press contacted with said first heating means;

detecting means for detecting the temperature of said surface;

control means, associated with said detecting means, for controlling said second heating means in response to the temperature of said surface; and blowing means for cooling said surface in response to the temperature of said surface.

8. An apparatus according to claim 1, wherein said surface of said first heating means comprises a surface of a roller, and said urging means includes at least one rotatable roller for press-contacting said toner image bearing member against said first heating means roller, wherein said radiant heat is applied at least to the contact area between said rollers.

9. An apparatus according to claim 8, wherein said second heating means includes a lamp for supplying said radiation heat, and said control means includes means connected to said lamp for turning said lamp on and off.

10. An apparatus according to claim 1, wherein said urging means includes a roller for urging said toner image bearing member against the surface of said cylinder, and wherein the radiation heat is applied at least to a contact area between said cylinder and the roller.

11. A fixing apparatus comprising:

first heating means, having a heatable surface which is contactable with a toner image bearing member, for heating a toner image on said toner image bearing member;

urging means for press-contacting the toner image bearing member to said surface;

second heating means for applying radiant heat to the toner image on the toner image bearing member at least at an area where it is press contacted with said first heating means;

detecting means for detecting the temperature of said surface; and control means, associated with said detecting means, for controlling said second heating means in response to the temperature of said surface;

wherein said surface of said first heating means is a surface of a rotatable roller, and said first heating means includes a rotatable resilient roller contacting said rotatable roller, and a heat source for heating said resilient roller, which in turn heats said rotatable roller.

12. An apparatus according to claim 11, wherein said resilient roller is press-contacted to the rotatable roller, and the toner image bearing member passes through the contacting area therebetween.

13. An apparatus according to claim 11, wherein said rotatable roller is a hollow roller of a material capable of passing said radiation heat therethrough, and said second heating means is disposed within the hollow roller.

14. An apparatus according to claim 11, wherein said heat source includes a plurality of heating members, and further comprising means for selectively actuating said heating members.

15. A fixing apparatus comprising:

a rotatable roller formed of a material capable of passing radiant heat therethrough;

means for heating said rotatable roller;

a pressure roller disposed in contact with said rotatable roller and adapted to cooperate with said rotatable roller to press a toner image bearing member;

radiation heating means disposed within said rotatable roller, for applying radiant heat at least to a contact area between said rollers;

detecting means for detecting the temperature of the surface of said rotatable roller; and means for controlling said heating means and said radiation heating means in response to the temperature detected by said detecting means.

16. Heat-fusing apparatus comprising:

a rotatable cylinder capable of transferring heat through its walls;

a rotatable press-contacting roller having a resilient surface for press-contacting a toner image bearing side of a toner image bearing member against a surface of said cylinder;

a rotatable heating roller disposed in contact with said cylinder, said heating roller being heated by a first heat source;

a second heat source disposed within said cylinder;

reflecting means for reflecting the heat emitted from said second heat source toward at least a contact area between said cylinder and said resilient roller;

means for detecting the temperature of said cylinder; and means for controlling said second heat source in response to the temperature detected by said detecting means, thereby maintaining the surface of said cylinder at a predetermined temperature.

* * * * *